US011131111B2

(12) United States Patent
Hudson

(10) Patent No.: US 11,131,111 B2
(45) Date of Patent: Sep. 28, 2021

(54) MAST COUPLING ASSEMBLY FOR A MOBILE DRILLING MACHINE

(71) Applicant: Caterpillar Global Mining Equipment LLC, Denison, TX (US)

(72) Inventor: Charles Taylor Hudson, Sherman, TX (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 40 days.

(21) Appl. No.: 16/536,844

(22) Filed: Aug. 9, 2019

(65) Prior Publication Data

US 2021/0040763 A1 Feb. 11, 2021

(51) Int. Cl.
*E21B 15/00* (2006.01)
*E04H 12/34* (2006.01)
*E21B 7/02* (2006.01)

(52) U.S. Cl.
CPC ..... *E04H 12/345* (2013.01); *E21B 7/023* (2013.01); *E21B 15/00* (2013.01)

(58) Field of Classification Search
CPC ..... E04H 12/345; E21B 7/02; E21B 15/00; E21B 15/003; E21B 7/023
USPC ..... 173/28; 175/85
See application file for complete search history.

(56) References Cited

U.S. PATENT DOCUMENTS 820,992 A * 5/1906 Schwarz
2,842,340 A * 7/1958 Burress ..... E21B 7/027 173/27
3,205,627 A * 9/1965 Gyongyosi ..... E21B 15/04 52/115
3,483,933 A 12/1969 Dyer et al.
4,046,209 A 9/1977 LaCasse
4,088,289 A * 5/1978 Wood ..... E21B 7/023 173/28
4,368,602 A * 1/1983 Manten ..... E21B 7/024 173/28
4,371,041 A * 2/1983 Becker ..... E21B 19/02 173/28
7,249,629 B2 * 7/2007 Cunningham ..... E21B 7/024 166/77.1
8,485,288 B2 * 7/2013 Kaethner ..... E02F 9/2257 180/9.52
8,549,815 B2 10/2013 Donnally et al.
8,782,968 B2 * 7/2014 Benson ..... E21B 15/04 52/116

(Continued)

*Primary Examiner* — Brian E Glessner
*Assistant Examiner* — Daniel J Kenny

(57) ABSTRACT

A drilling machine is disclosed. The drilling machine may include a mast and a machine frame. The mast may include a mast frame, a movable drill head assembly, a first pivot aperture, and a plurality of first lock apertures each corresponding to a different drilling position of the mast. The machine frame may include an engine, a ground engaging assembly having an axle, and a mast coupling assembly having at least a pair of opposed legs, each leg including at least one plate. The at least one plate of each leg may include a second pivot aperture positioned to align with the first pivot aperture to pivotably couple the mast to each leg. The at least one plate may also include a second lock aperture positioned to align with each of the first lock apertures and receive a lock pin for locking the mast in a drilling position.

20 Claims, 4 Drawing Sheets

(56) References Cited

U.S. PATENT DOCUMENTS 9,284,168 B2 * 3/2016 Mau ..... B66C 23/80
9,869,109 B2 1/2018 Thiessen et al.

* cited by examiner

MAST COUPLING ASSEMBLY FOR A MOBILE DRILLING MACHINE

TECHNICAL FIELD

The present disclosure relates generally to mobile drilling machines, and more particularly, to a mast coupling assembly for such drilling machines.

BACKGROUND

Mobile drilling machines, such as blast hole drilling machines, are typically used for drilling blast holes for mining, quarrying, dam construction, and road construction, among other uses. The process of excavating rock, or other material, by blast hole drilling comprises using the blast hole drill machine to drill a plurality of holes into the rock and filling the holes with explosives. The explosives are detonated causing the rock to collapse, and rubble of the collapse is then removed and the new surface that is formed is reinforced. Many blast hole drilling machines utilize rotary drill heads, mounted on a mast, that can drill blast holes anywhere from 6 inches to 22 inches in diameter and depths up to 150 feet. A coupling assembly, known as an A-frame, is typically used to pivotably mount the mast onto the mobile drilling machine. Current coupling assemblies, and the corresponding couplings of the mast, may include pivot points at which the mast pivots in the coupling assembly. Further, current masts may include locking points at which the mast can be locked in a drilling position. However, current coupling assemblies may not properly account for, or distribute, loads from the mast on the coupling assembly (e.g., through the pivot points).

U.S. Pat. No. 9,869,109, issued to Thiessen et al. on Jan. 16, 2018 ("the '109 patent"), describes a drilling rig mast having a mast supported by an A-frame structure. The mast may be pivotably attached to support shoes of a frame of the drilling rig. The A-frame structure of the '109 patent may also be attached to the support shoes. However, the drilling rig of the '109 patent is not a mobile drilling machine. Further, the mast and the A-frame structure of the '109 patent may not be easily machinable. Moreover, the mast and the A-frame structure may not be able to properly account for loads, such as axial, horizontal, or eccentric axial loads.

The mobile drilling machine of the present disclosure may solve one or more of the problems set forth above and/or other problems in the art. The scope of the current disclosure, however, is defined by the attached claims, and not by the ability to solve any specific problem.

SUMMARY

In one aspect, a drilling machine is disclosed. The drilling machine may include: a mast including a mast frame, a movable drill head assembly, a first pivot aperture, and a plurality of first lock apertures each corresponding to a different drilling position of the mast. The machine frame may include an engine, a ground engaging assembly having an axle extending through the machine frame, and a mast coupling assembly having at least a pair of opposed legs, each leg including at least one plate, wherein the at least one plate includes: a second pivot aperture positioned to align with the first pivot aperture of the mast to pivotably couple the mast to each leg; and a second lock aperture positioned to align with each of the first lock apertures and receive a lock pin for locking the mast in a drilling position.

In another aspect, a drilling machine is disclosed. The drilling machine may include: a mast having a mast frame including at least a pair of opposing side plates and a movable drill head assembly slidably mounted on the mast frame, wherein each side plate includes: a first pivot aperture; and a plurality of first lock apertures each corresponding to a different drilling position of the mast; and a machine frame including an engine, a ground engaging assembly having an axle extending through the machine frame, and a mast coupling assembly having at least a pair of opposing legs, each leg including: a second pivot aperture positioned to align with the first pivot aperture of the side plate to pivotably couple the mast to the each leg; and a second lock aperture positioned to align with each of the first lock apertures of the side plate and receive a lock pin for locking the mast in a drilling position.

In yet another aspect, a drilling machine is disclosed. The drilling machine may include: a mast including a mast frame, a movable drill head assembly, a first pivot aperture, and a plurality of first lock apertures each corresponding to a different drilling position of the mast; and a machine frame including an engine, a ground engaging assembly having an axle extending through the machine frame, and a mast coupling assembly having at least a pair of opposing legs, each leg including: a second pivot aperture; a second lock aperture; and a support portion coupled to the axle.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Further, relative terms, such as, for example, "about," "substantially," "generally," and "approximately" are used to indicate a possible variation of ±10% in a stated value.

Figure 1:
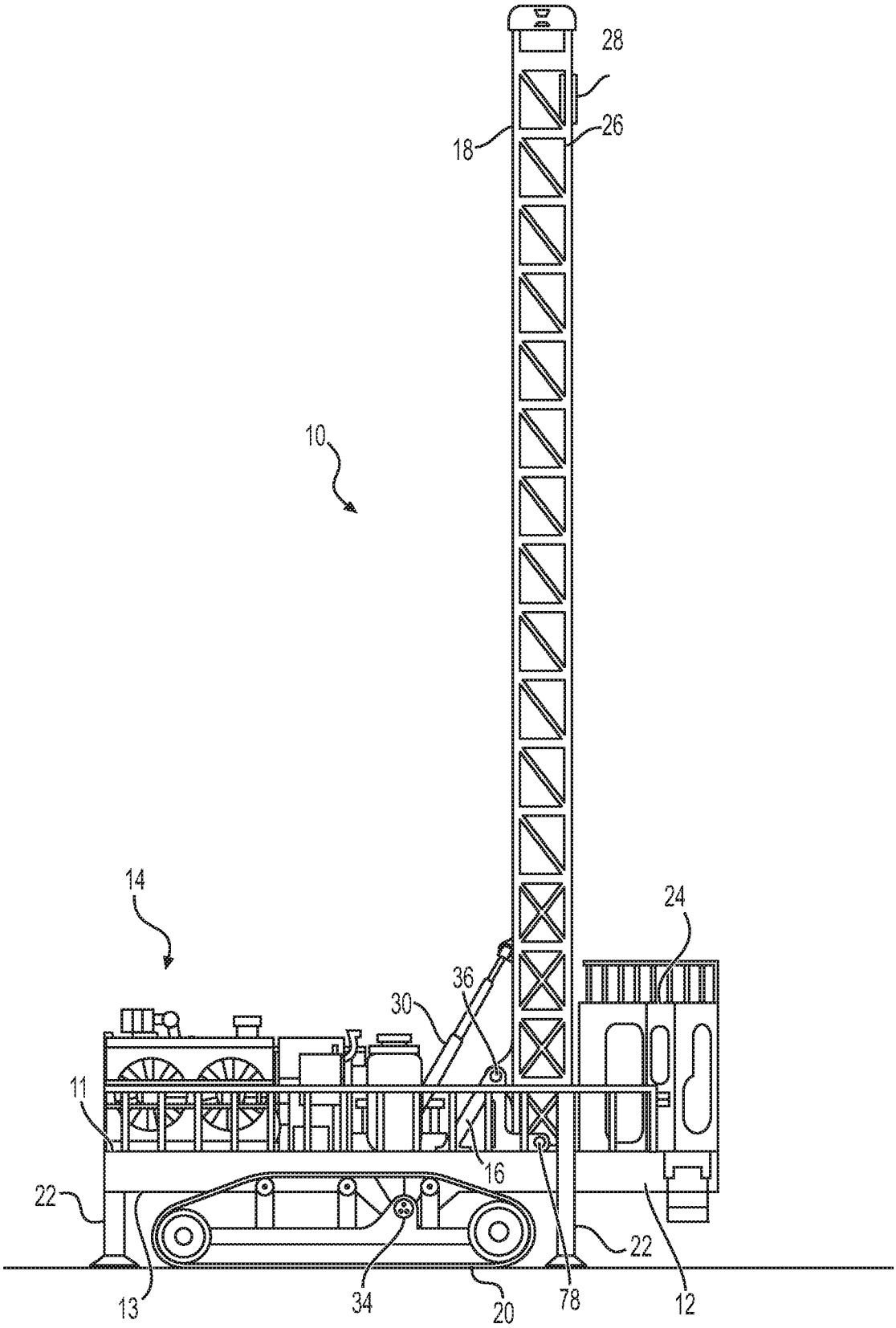
FIG. 1 illustrates a side view of an exemplary mobile drilling machine according to aspects of this disclosure.
Figure 2:
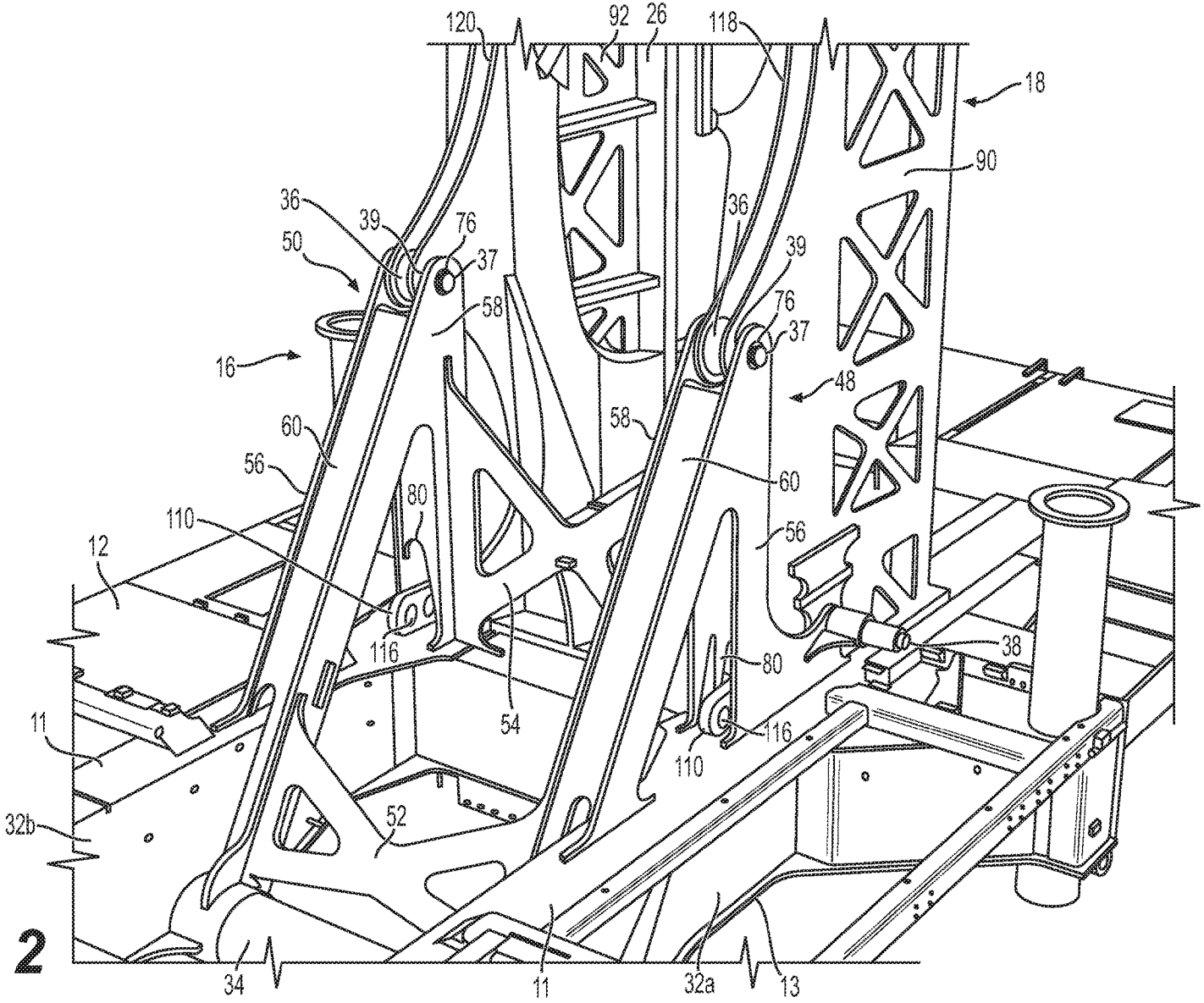
FIG. 2 illustrates a perspective view of an exemplary mast mounted on a mast coupling assembly of the mobile drilling machine of FIG. 1.

FIG. 1 illustrates a side view of an exemplary mobile drilling machine 10, such as a blast hole drilling machine. As shown in FIG. 1, mobile drilling machine 10 may include a machine frame 12 having a top side 11 and a bottom side 13, machinery 14, a mast coupling assembly 16, and a mast 18. Machine frame 12 may be supported on a ground surface by a transport mechanism 20, such as crawler tracks or the like. Transport mechanism 20 may include a plurality of axles 34 for rotating wheel components and rollers of the transport mechanism 20. The plurality of axles 34 may include a stationary component (as shown in FIG. 2) coupled to machine frame 12 and a rotating component mounted inside the stationary component for rotating the wheels and/or rollers. A continuous track chain looped around the wheel components and rollers may be driven by the wheel components and rollers. As such, transport mechanism 20 may allow drilling machine 10 to maneuver about the ground surface to a desired location for a drilling operation.

Machine frame 12 may further include one or more jacks 22 for supporting and leveling mobile drilling machine 10 on the ground surface during the drilling operation. Machine frame 12 may support the machinery 14, which may include motors, an engine, batteries, compressors, pumps, hydraulic systems, and any other equipment necessary to power and operate mobile drilling machine 10. Machine frame 12 may further support an operator cab 24, from which an operator may maneuver and control mobile drilling machine 10. In some embodiments, mobile drilling machine 10 may be maneuvered and controlled by an operator remotely and/or may be controlled automatically without intervention, or input, from an operator.

As further shown in FIG. 1, the mast coupling assembly 16 of the mobile drilling machine 10 connects mast 18 onto the mobile drilling machine 10. Mast 18 may include a mast frame 26 which may support the movable drill head assembly 28 (shown schematically in FIG. 1). Drill head assembly 28 may couple to, and may be controllable to rotate, a drill string (not shown) of one or more drill pipes (not shown). A drill tool (not shown), such as a drill bit, may be mounted at a bottom end of the drill string for drilling into the ground surface. The drill head assembly 28 may include any type of drill head, such as a fluid motor-type hydraulic rotary head or the like and the drill tool may be any type of drill tool, such as a rotary drill bit, a claw bit, a hammer bit, or the like. Mast 18 may be any suitable mast capable of being mounted with mast coupling assembly 16.

Mast coupling assembly 16 may be mounted to, and within, machine frame 12 and may support the mast 18 at a pivot 36, as detailed further below. Mast 18 may further be supported by at least one fluid cylinder 30 attached to mast 18 at a position above pivot 36. The at least one fluid cylinder 30 may be any suitable actuator, such as a hydraulic or pneumatic cylinder or the like. The at least one fluid cylinder 30 may be configured to apply a force to the mast 18 to rotate the mast 18 about pivot 36. Thus, the at least one fluid cylinder 30 may assist in moving the mast 18 between a stowed, substantially horizontal, position to a vertical position for a drilling operation. It is understood that the at least one fluid cylinder 30 may assist in moving the mast 18 to any angle between the stowed position and the vertical position.

FIG. 2 illustrates a perspective view of an exemplary mast coupling assembly 16 mounted in the machine frame 12 of the mobile drilling machine 10. Machine frame 12 may comprise one or more beams 32*a*, 32*b*. For example, machine frame 12 may include at least a first beam 32*a* and a second beam 32*b*. However, machine frame 12 may include any number of beams 32, as necessary. Mast coupling assembly 16 may be arranged between the first beam 32*a* and the second beam 32*b*. For example, mast coupling assembly 16 may be coupled to the top side 11 of machine frame 12. Machine frame 12 may also include an axle 34 of transport mechanism 20 located in front of the pivot 36 and extending between the first beam 32*a* and the second beam 32*b*. Mast coupling assembly 16 may further be coupled to axle 34, as further detailed below. Mast coupling assembly 16 may be attached to the first beam 32*a*, the second beam 32*b*, and axle 34 by any conventional manner known in the art, such as by welding or the like.

Figure 3:
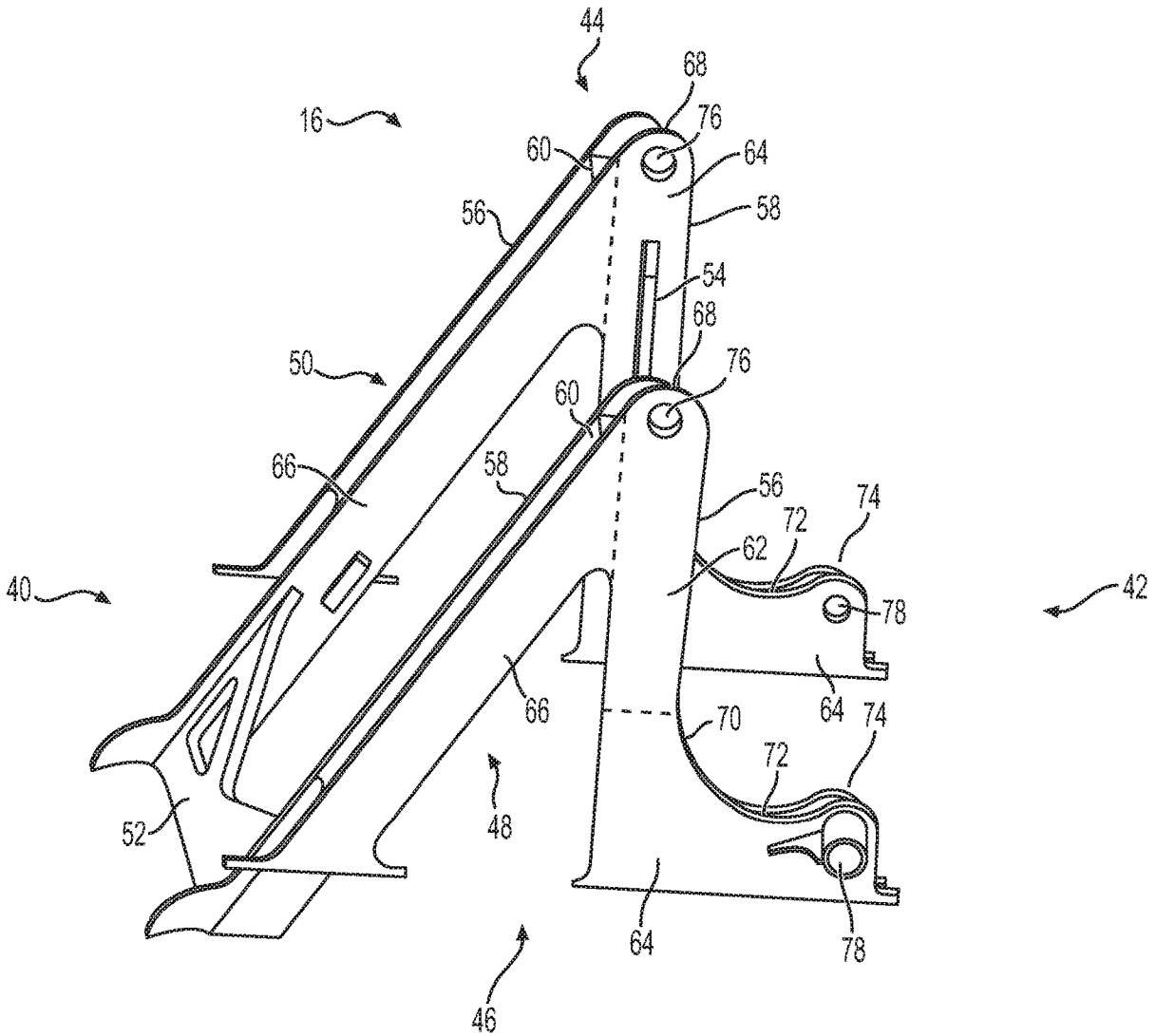
FIG. 3 illustrates a side perspective view of the mast coupling assembly isolated from the mobile drilling machine of FIG. 1.

As further shown in FIG. 2, mast 18 may be mounted within mast coupling assembly 16 and may be supported at pivot 36. For example, pivot 36 may include a pin 37 placed through first pivot apertures of mast 18 and second pivot apertures 76 of mast coupling assembly 16. In some embodiments, pivot 36 may include a hollow component aligned with, and between, the pivot aperture 39 of a side plate 90 and a reinforcing plate 118 of mast 18 for receiving the pin 37. Likewise a hollow cylindrical component may be aligned with, and between, the pivot aperture 39 of a side plate 92 and a reinforcing plate 120 of mast 18 for receiving another pin 37. Mast 18 may move/rotate within mast coupling assembly 16 about pivot 36 (e.g., mast 18 may rotate with respect to pin 37) in order to move from the stowed position into a drilling position for a desired drilling angle. When mast 18 is set to the desired drilling angle position, it may be locked into place using a locking mechanism, such as lock pin 38. For example, lock pin 38 may be a hydraulic lock pin such that the lock pin 38 may be extended and retracted by a hydraulic actuator. As such, lock pin 38 may be attached on machine frame 12 and may be extended and inserted into a respective lock aperture 78 (as shown in FIG. 3) of the mast coupling assembly 16 and into a respective lock aperture 116 of mast 18 to lock the mast 18 into place during a drilling operation. It is understood that lock pin 38 may include any type of locking mechanism and may include any type of actuator for extending and retracting lock pin 38.

FIG. 3 illustrates a side perspective view of mast coupling assembly 16 isolated from the mobile drilling machine 10. As shown in FIG. 3 (and with reference to FIG. 2), mast coupling assembly 16 may include a front end 40, a rear end 42, a top end 44, and a bottom end 46. Mast coupling assembly 16 may comprise a first leg 48, a second leg 50, a first reinforcing plate 52 coupled between the legs 48, 50, and a second reinforcing plate 54 coupled between the legs 48, 50. Each leg 48, 50 may include a first plate 56 and a second plate 58. As used herein, a "plate" is a thin flat or curved piece of material. It is understood that mast coupling assembly 16 may include any number of legs and any number of plates for each leg. The first plates 56 may be coupled to top side 11 of machine frame 12 and the second plates 58 may be coupled to top side 11 of machine frame 12 at a rear end 42 and coupled to axle 34 at a front end 40. As shown in FIG. 2, first leg 48 may be coupled to first beam 32*a* and second leg 50 may be coupled to second beam 32*b*.

The first plate 56 and the second plate 58 may be aligned and spaced apart from each other such that the first plate 56 and the second plate 58 are parallel to one another and one or more third reinforcing plates 60 may be coupled between the first and second plates 56, 58. As such, first plate 56, second plate 58, and reinforcing plate 60 may be connected such that each leg 48, 50 includes a box-like structure. Further, first and second reinforcing plates 52, 54 may be coupled between first and second legs 48, 50 such that first leg 48, second leg 50, and reinforcing plates 52, 54 form a singular structure of mast coupling assembly 16. It is understood that plates 56, 58 and reinforcing plates 52, 54, 60 may be separate parts coupled together, such as by welding or the like, or may be formed, partially or completely, together as a singular part.

The first and second plates 56, 58 (and thus first and second legs 48, 50) may comprise a shape that may allow for a desired strength-to-weight ratio to enable the mast coupling assembly 16 to support the weight of the mast 18. As such, the first and second plates 56, 58 may include a top portion 62, a bottom portion 64, and a front portion 66 (distinguished by dashed lines in FIG. 3). The top, bottom, and front portions 62, 64, 66 may be portions of plates 56, 58 such that the plates 56, 58 are continuous plates from front portion 66 to top portion 62 to bottom portion 64. The top portion 62 of the first and second plates 56, 58 may comprise a substantially rectangular shape and may be oriented substantially vertically when mast coupling assembly 16 is coupled to machine frame 12. The substantially rectangular shape of the top portion 62, or vertical portion, may have a rounded apex 68 at a top end 44 of the top portion 62. A first side of top portion 62 at the rear end 42 may transition into the bottom portion 64 of the first and second plates 56, 58. A second side of top portion 62 at the front end 40 of top portion 62 may transition into the front portion 66 of the first and second plates 56, 58.

At the rear end 42 of the plates 56, 58, the bottom portion 64 may include a rear edge 70 that includes a concave portion 72 that may transition into a convex portion 74. As such, bottom portion 64 may extend aft of the top portion 62 towards the rear end 42. A bottom end 46 of bottom portion 64 may include a substantially flat and straight edge. As such, bottom portion 64 may be coupled at the bottom end 46 to the top side 11 of machine frame 12. A front end 40 side of bottom portion 64 may extend upwards and transition to the second side of top portion 62 at the front end 40 of top portion 62.

Front portion 66, or support portion, may extend from top portion 62 towards front end 40 of mast coupling assembly 16. For example, front portion 66 may extend from top portion 62 at an angle less than ninety degrees such that a gap exists between front portion 66 and the front end 40 side of bottom portion 64. As such, first and second legs 48, 50 may form a generally "A" shape. It is understood that front portion 66 may extend from top portion 62 at any angle. Further, front portion 66 may be continuous with top portion 62 and bottom portion 64 such that a gap does not exist and first and second plates 56, 58 are solid continuous plates. A bottom end 46 of front portion 66 of first plate 56 may include a substantially flat and straight edge. As such, the front portion 66 of first plate 56 may be coupled at the bottom end 46 to the top side 11 of machine frame 12. Further, front portion 66 of second plate 58 may include a length such that front portion 66 of second plate 58 extends below the top side 11 of machine frame 12 when mast coupling assembly 16 is mounted to machine frame 12. For example, front portion 66 of second plate 58 may be longer than front portion 66 of first plate 56. However, the front portions 66 of first and second plates 56, 58 may include the same length and may both be coupled to axle 34. A bottom end 46 of front portion 66 of second plate 58 may include a substantially arc shape having a radius corresponding to an outer diameter of axle 34. As such, front portion 66 of second plate 58 may be coupled at the bottom end 46 to a stationary component of axle 34.

As further shown in FIGS. 2 and 3, the first and second legs 48, 50 may include a number of holes and/or apertures. For example, top portion 62 of plates 56, 58 may include a pivot aperture 76 located adjacent the apex 68. As such, pivot aperture 76 may be located at a top end 44 of mast coupling assembly 16. Pivot aperture 76 may be positioned to align with pivot aperture 39 of mast 18 such that mast 18 may be pivotably coupled (e.g., at pivot 36) between the first and second plates 56, 58 of each leg 48, 50 of mast coupling assembly 16. Pivot aperture 76 of each plate 56, 58 may be reinforced to provide additional support when mast 18 is mounted. Each plate 56, 58 may further include a lock aperture 78 located adjacent the convex portion 74 of bottom portion 64. Thus, each plate 56, 58 may include a pivot aperture 76 and a lock aperture 78. For example, pivot aperture 76 and lock aperture 78 of first plate 56 may be located on the same plate and pivot aperture 76 and lock aperture 78 of second plate 58 may be located on the same plate. Lock aperture 78 may be located adjacent the rear end 42 of bottom portion 64 of the plates 56, 58. The lock aperture 78 may be a second lock aperture and may be positioned to align with a plurality of first lock apertures 116 of mast 18. Lock aperture 78 and each of the plurality of first lock apertures 116 may receive lock pin 38, or similar device, for locking mast 18 in a drilling position, as detailed further below. Further, lock aperture 78 may be located below and aft of pivot aperture 76. As shown in FIG. 2, lock aperture 78 may also be located above top side 11 of machine frame 12 when mast coupling assembly 16 is coupled to machine frame 12.

With reference to FIG. 2, first and second plates 56, 58 may be spaced apart for receiving a lock portion 110 of mast 18 between the first and second plates 56, 58. Further, reinforcing plate 60 of each leg 48, 50 may include a hole 80 for receiving the lock portion 110. The hole 80 may be positioned and sized such that the lock portion 110 may swing through the hole 80 as mast 18 is pivoted to a drilling position, as detailed further below. It is understood that in some embodiments, reinforcing plate 60 may terminate before bottom portion 64 of plates 56, 58 such that only a gap exists between the bottom portions 64, and thus hole 80 may not be needed or included.

Reinforcing plates 52, 54 may provide additional reinforcement between first and second legs 48, 50. For example, reinforcing plates 52, 54 may extend between second plates 58 of each leg 48, 50 and may be attached to second plates 58 using any conventional attachment means, such as by welding or the like. As shown in FIG. 2, reinforcing plate 52 may be coupled to front portion 66 and reinforcing plate 54 may be coupled to both top portion 62 and bottom portion 64 of plate 58 of each leg 48, 50. In the exemplary embodiment, reinforcing plates 52, 54 may have one or more holes or cutouts in order to reduce weight. However, reinforcing plates 52, 54 may also be solid plates. Reinforcing plate 54 may further provide a backstop for mast 18, such that mast 18 may not pivot past reinforcing plate 54. It is understood that mast coupling assembly 16 may include any number of reinforcing plates positioned in any location of mast coupling assembly 16.

Figure 4:
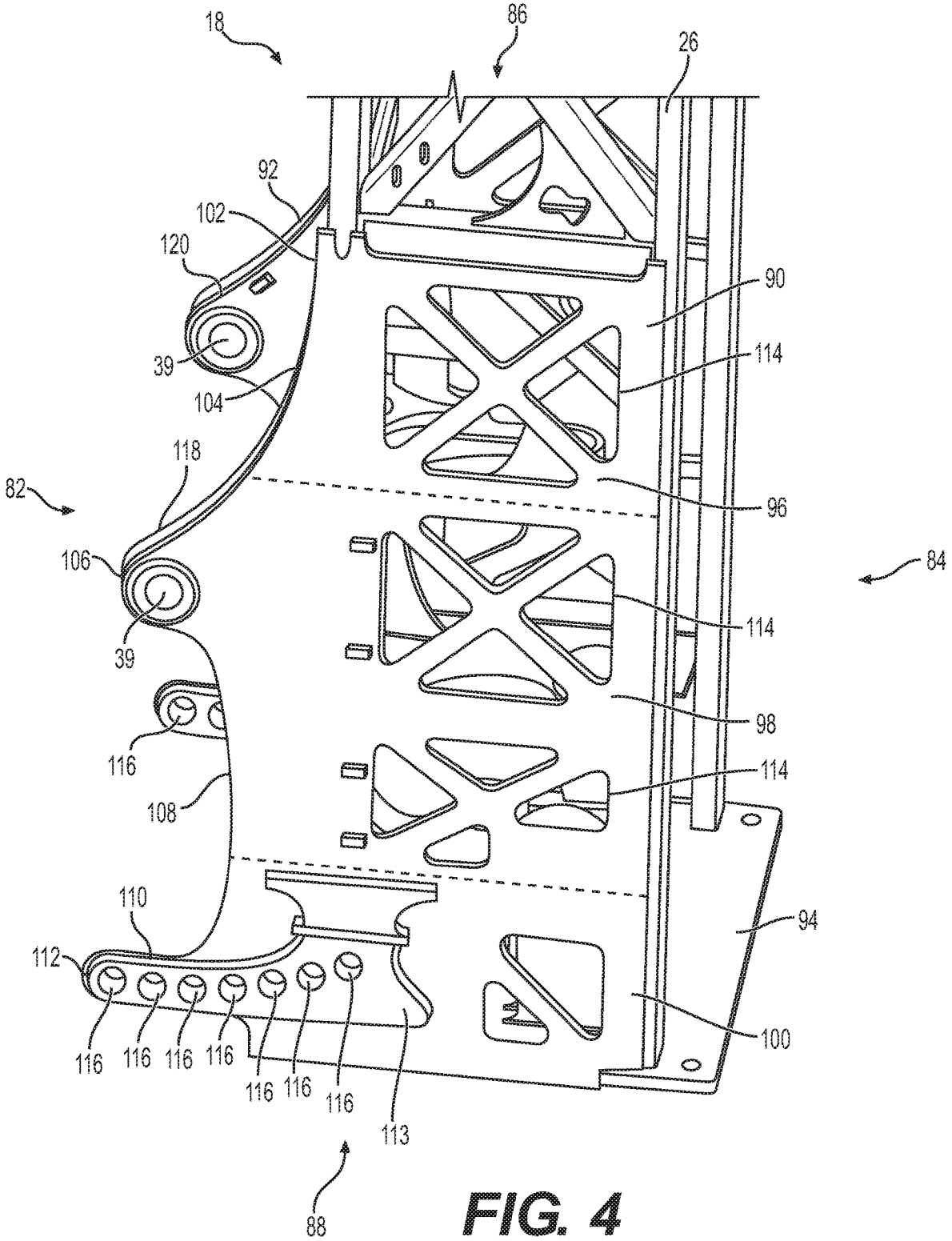
FIG. 4 illustrates a side perspective view of a bottom portion of the mast isolated from the mobile drilling machine of FIG. 1.

FIG. 4 illustrates a side perspective view of a bottom portion of mast 18 isolated from the mobile drilling machine 10. As shown in FIG. 4 (and with reference to FIG. 2), the bottom portion of mast 18 may include a front end 82, a rear end 84, a top end 86, and a bottom end 88. The bottom portion of mast 18 may comprise a first side plate 90, a second side plate 92, and a bottom plate 94. First side plate 90 and second side plate 92 may be coupled to, and form a part of, mast frame 26. For example, first and second side plates 90, 92 may be coupled to an outside surface of mast frame 26 and form sides of mast frame 26 at the bottom portion of mast 18. Bottom plate 94 may be attached to and extend between the bottom ends 88 of first and second side plates 90, 92 such that bottom plate 94 provides a bottom of mast 18. Bottom plate 94 may include an opening (not shown) for receiving the drill string such that the drill string may move through the opening during the drilling operation. It is understood that mast 18 may include any number of side plates 90, 92. Further, side plates 90, 92 and bottom plate 94 may be separate parts coupled together, such as by welding or the like, or may be formed together as a singular part.

First and second side plates 90, 92 may comprise a shape that may allow for a desired strength-to-weight ratio to support the weight of mast 18 when mast 18 is mounted to mast coupling assembly 16. As such, the first and second side plates 90, 92 may include a top portion 96 at a top end 86, a bottom portion 100 at a bottom end 88, and a middle portion 98 between the top and bottom portions 96, 100 (distinguished by dashed lines in FIG. 4). The top, middle, and bottom portions 96, 98, 100 may be portions of side plates 90, 92 such that the side plates 90, 92 are continuous plates from top portion 96 to middle portion 98 to bottom portion 100. Further, the first and second side plates 90, 92 may include a substantially rectangular shape including a curved front edge 102 on the front end 82. The front edge 102 of side plates 90, 92 may include a first concave portion 104 at the top portion 96. The first concave portion 104 of front edge 102 may transition into a convex portion 106 located on the middle portion 98 of plates 90, 92. The convex portion 106 may transition into a second concave portion 108 located on the bottom portion 100 of plates 90, 92. As such, the convex portion 106 of front edge 102 may be located forward of the concave portions 104, 108. The second concave portion 108 may transition into the lock portion 110 of mast 18. Lock portion 110 may be located on the bottom portion 100 of side plates 90, 92 and may extend forward from the second concave portion 108. Further, lock portion 110 may be located and positioned above bottom plate 94 when mast 18 is assembled. Lock portion 110 may include a generally rectangular shape having a rounded apex 112 and may be sized such that lock portion 110 may swing through hole 80 of mast coupling assembly 16 (as shown in FIG. 2) as mast 18 is pivoted to a drilling position, as detailed below. Lock portion 110 may further include a support plate 113 including a substantially similar shape as lock portion 110. Support plate 113 may include lock apertures 116 aligned with lock apertures 116 of lock portion 110 and may provide additional structural support for lock apertures 116 of lock portion 110.

As further shown in FIGS. 2 and 3, the first and second side plates 90, 92 may include a number of holes and/or apertures. For example, side plates 90, 92 may have one or more holes or cutouts 114 in order to reduce weight. However, side plates 90, 92 may also be substantially solid plates. Further, the convex portion 106 may include a pivot aperture 39 located adjacent the front edge 102. As such, pivot aperture 39 may be located on the middle portion 98 of side plates 90, 92. Pivot aperture 39 of mast 18 may be positioned to align with pivot aperture 76 of mast coupling assembly 16 such that mast 18 may be pivotably coupled at pivot 36 to mast coupling assembly 16 (e.g., by pin 37). For example, mast 18 may be rotatably mounted within mast coupling assembly 16 at pivot 36 between first and second plates 56, 58. Thus, mast 18 may pivot, or rotate, within mast coupling assembly 16. Further, lock portions 110 (and/or bottom portion 100) of side plates 90, 92 may be positioned between the first and second plates 56, 58 of each leg 48, 48 of mast coupling assembly 16 with a minimal clearance. For example, the clearance between lock portion 110 and the first and second plates 56, 58 may be less than seven inches (17.78 cm). Pivot aperture 39 may be reinforced to provide additional support when mast 18 is mounted.

The plates 90, 92 may further include the plurality of first lock apertures 116. Thus, each plate 90, 92 may include a pivot aperture 39 and a plurality of first lock apertures 116. For example, pivot aperture 39 and first lock apertures 116 of first side plate 90 may be located on the same plate and pivot aperture 39 and first lock apertures of second side plate 92 may be located on the same plate. The plurality of first lock apertures 116 may be located on the lock portion 110 such that the plurality of first lock apertures 116 are located above bottom plate 94. The plurality of first lock apertures 116 may each correspond to a different drilling angle position of mast 18. Further, the plurality of first lock apertures may be aligned such that the mast 18 is capable of being locked at different drilling angles between the stowed position and the vertical position. FIGS. 1 and 2 depict mast 18 in the vertical position. While seven first lock apertures 116 are illustrated in FIG. 4, it is understood that any number of lock apertures 116 may be included and may be positioned to lock mast 18 at any drilling angle between the stowed position and the vertical position. The plurality of first lock apertures 116 may be reinforced to provide additional support when the lock pin 38 is inserted into a respective first lock aperture 116.

In some embodiments, mast 18 may further include reinforcing plates 118, 120. Reinforcing plates 118, 120 may be include a substantially similar or same shape as portions of first and second side plates 90, 92. For example, reinforcing plates 118, 120 may include a front edge 104 having a first concave portion 104, a convex portion 106, and a second concave portion 108. Convex portion 106 may also include a pivot aperture 39, located adjacent the front edge 102 of reinforcing plates 118, 120. Reinforcing plates 118, 120 may be spaced apart from side plates 90, 92 and connected to an inside surface of mast frame 26 such that the first concave portions 104, convex portions 106, second concave portions 108, and pivot apertures 39 of reinforcing plates 118, 120 and side plates 90, 92 are substantially aligned.

INDUSTRIAL APPLICABILITY

The disclosed aspects of mast coupling assembly 16 may be used by any mobile drilling machine 10 for mounting a mast 18 of the mobile drilling machine 10.

Referring to FIGS. 1 and 2, during operation, an operator may raise the mast 18 to a drilling angle position by activating, for example, two fluid cylinders 30 using a control in the operator cab 24. As such, the fluid cylinders 30 may move the mast 18 between a stowed position and a vertical position to a desired drilling angle position. Accordingly, mast 18 may pivot, or rotate, about pivot 36 at pivot apertures 76 of mast coupling assembly 16. When the desired drilling angle position is reached, a respective first lock aperture 116 of mast 18 may be aligned with lock aperture 78 of mast coupling assembly 16. Mast 18 may then be locked into place by extending lock pin 38 into the lock aperture 78 of mast coupling assembly 16 and the respective first lock aperture 116 of mast 18. Lock pin 38 may be extended and retracted by the operator using a control in the operator cab 24. For example, a hydraulic actuator may be actuated to extend lock pin 38 into the respective lock apertures 78, 116 for locking the mast 18 in the drilling position. Likewise, the hydraulic actuator may be actuated to retract lock pin 38 out of the respective lock apertures 78, 116 for unlocking mast 18 such that mast 18 may be pivoted about pivot 36.

As mast 18 is moved beyond a certain angle, lock portions 110 of first and second side plates 90, 92 of mast 18 may move between first and second plates 56, 58 of each respective leg 48, 48 of mast coupling assembly 16. For example, when mast 18 is moved beyond a minimum drilling angle (e.g., corresponding to a front-most first lock aperture 116), lock portions 110 may move between the first and second plates 56, 58. As such, lock portions 110 may "swing through" legs 48, 50. Further, a portion of lock portions 110 may swing through holes 80 of reinforcing plates 60 of each respective leg 48, 50.

The exemplary mobile drilling machine 10 of the disclosure may provide for an arrangement that facilitates ease of machining, while distributing high loads from mast 18 on mast coupling assembly 16. For example, positioning the lock aperture 78 of mast coupling assembly 16 on the same plate 56, 58 as pivot aperture 76 may enable faster and easier machining. Likewise, positioning the first lock apertures 116 of mast 18 above the top side 11 of machine frame 12 and on the same plate 90, 92 as pivot aperture 39 may enable faster and easier machining. Mast coupling assembly 16 may further center the loading from mast 18 on each leg 48, 50, while keeping the lock loading (e.g., at lock pin 38) in line with legs 48, 50 by allowing lock portions 110 to swing through the legs 48, 50. A clearance of less than seven inches (17.78 cm) between the lock portion 110 of side plates 90, 92 and the first and second plates 56, 58 of each leg 48, 50 may reduce additional loads, such as horizontal or eccentric axial loads. For example, such a minimal clearance may reduce the horizontal and eccentric axial loads on the lock pin 38 by reducing the amount of movement, or shift, of mast 18 towards, and away from, plates 56, 58 during movement of mobile drilling machine 10. Further, attaching mast coupling assembly 16 to axle 34 may relieve a portion of the loads from mast 18 on machine frame 12 and transfer the loads to the ground.

It will be apparent to those skilled in the art that various modifications and variations can be made to the disclosed system without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A drilling machine, comprising:

a mast including a mast frame, a movable drill head assembly, a first pivot aperture, and a plurality of first lock apertures each corresponding to a different drilling position of the mast; and a machine frame including an engine, a ground engaging assembly having an axle assembly extending through the machine frame, and a mast coupling assembly having at least a pair of opposed legs, each leg including at least one plate, wherein the at least one plate includes:

a second pivot aperture positioned to align with the first pivot aperture of the mast to pivotably couple the mast to each leg; and a second lock aperture positioned to align with each of the first lock apertures and receive a lock pin for locking the mast in a drilling position.

2. The drilling machine of claim 1, wherein the second lock aperture is located below the second pivot aperture.

3. The drilling machine of claim 2, wherein the second lock aperture is located above a top side of the machine frame.

4. The drilling machine of claim 1, wherein the at least one plate includes a first plate and a second plate spaced apart from the first plate.

5. The drilling machine of claim 4, wherein a lock portion of the mast that includes the plurality of first lock apertures is configured to swing between the first plate and the second plate as the mast is pivoted to a drilling position.

6. The drilling machine of claim 1, wherein the mast coupling assembly is coupled to a stationary component of the axle assembly.

7. A drilling machine, comprising:

a mast having a mast frame including at least a pair of opposing side plates and a movable drill head assembly slidably mounted on the mast frame, wherein each side plate includes:

a first pivot aperture; and a plurality of first lock apertures each corresponding to a different drilling position of the mast; and a machine frame including an engine, a ground engaging assembly having an axle assembly extending through the machine frame, and a mast coupling assembly having at least a pair of opposing legs, each leg including:

a second pivot aperture positioned to align with the first pivot aperture of the side plate to pivotably couple the mast to the each leg; and a second lock aperture positioned to align with each of the first lock apertures of the side plate and receive a lock pin for locking the mast in a drilling position.

8. The drilling machine of claim 7, wherein the mast frame includes a bottom plate and the plurality of first lock apertures are located above the bottom plate.

9. The drilling machine of claim 8, wherein the plurality of first lock apertures are aligned such that the mast is capable of being locked at drilling angles between a stowed position and a vertical position.

10. The drilling machine of claim 7, wherein each leg of the mast coupling assembly further includes a first plate and a second plate spaced apart from the first plate.

11. The drilling machine of claim 10, wherein a lock portion of each side plate that includes the plurality of first lock apertures is configured to swing between the first plate and the second plate as the mast is pivoted to a drilling position.

12. The drilling machine of claim 11, wherein a clearance between the lock portion of each side plate and the first and second plates is less than seven inches.

13. The drilling machine of claim 7, wherein the mast coupling assembly is coupled to a stationary component of the axle assembly.

14. A drilling machine, comprising:

a mast including a mast frame, a movable drill head assembly, a first pivot aperture, and a plurality of first lock apertures being positioned at a bottom end of the mast frame each corresponding to a different drilling position of the mast; and a machine frame including an engine, a ground engaging assembly having an axle assembly extending through the machine frame, and a mast coupling assembly having at least a pair of opposing legs, each leg including:

a second pivot aperture;

a second lock aperture positioned to align with each of the first lock apertures and receive a lock pin for locking the mast in a drilling position; and a support portion coupled to the axle assembly.

15. The drilling machine of claim 14, wherein the mast coupling assembly is coupled to a top side of the machine frame.

16. The drilling machine of claim 15, wherein the support portion extends below the top side to couple to the axle.

17. The drilling machine of claim 16, wherein each leg includes a vertical portion and the support portion extends at an angle from the vertical portion to the axle.

18. The drilling machine of claim 14, wherein each leg further includes a first plate and a second plate spaced apart from the first plate.

19. The drilling machine of claim 18, wherein the second pivot aperture and the second lock aperture of each leg includes a second pivot aperture and a second lock aperture located on each of the first plate and the second plate, and wherein the support portion of each leg is located on the second plate.

20. The drilling machine of claim 19, wherein a lock portion of the mast that includes the plurality of first lock apertures is configured to swing between the first plate and the second plate as the mast is pivoted to a drilling position.

* * * * *